US005300199A

United States Patent [19]

Fyson

[11] Patent Number: 5,300,199

[45] Date of Patent: Apr. 5, 1994

[54] METHOD FOR RECOVERING SILVER FROM A PHOTOGRAPHIC FIXING SOLUTION

[75] Inventor: John R. Fyson, London, United Kingdom

[73] Assignee: Eastman Kodak Company, Rochester, N.Y.

[21] Appl. No.: 859,693

[22] PCT Filed: Dec. 4, 1990

[86] PCT No.: PCT/EP90/02110

§ 371 Date: Jun. 10, 1992

§ 102(e) Date: Jun. 10, 1992

[87] PCT Pub. No.: WO91/09159

PCT Pub. Date: Jun. 27, 1991

[30] Foreign Application Priority Data

Dec. 11, 1989 [GB] United Kingdom ..... 8927964

[51] Int. Cl.[5] ..... C25C 1/20

[52] U.S. Cl. ..... 204/109; 205/83

[58] Field of Search ..... 204/109, 260; 205/82, 205/83

[56] References Cited

U.S. PATENT DOCUMENTS

| | | | |
|---|---|---|---|
| 3,705,716 | 12/1972 | Hendrickson | 266/22 |
| 4,111,766 | 9/1978 | Idota et al. | 204/109 |
| 4,263,108 | 4/1981 | Berg et al. | 204/109 |
| 4,377,456 | 3/1983 | DeMeester et al. | 204/109 |
| 4,561,957 | 12/1985 | Palazzolo | 204/237 |
| 4,784,735 | 11/1988 | Sorenson | 204/260 |
| 4,834,849 | 5/1989 | Woog | 204/109 |

FOREIGN PATENT DOCUMENTS

| | | | |
|---|---|---|---|
| 2579998 | 3/1985 | France | 25/1/20 |
| 2004301A | 3/1979 | United Kingdom | 25/1/20 |

*Primary Examiner*—John Niebling
*Assistant Examiner*—Brendan Mee
*Attorney, Agent, or Firm*—Clyde E. Bailey

[57] ABSTRACT

Silver is able to be recovered from a photographic fixing solution by circulating the solution through a unit separate from, but connected to, a main unit. In the separate unit the solution is subjected to electrolysis by anodic and cathodic electrodes. The density of the current is limited to 100A/m$^2$ and the voltage is controlled up to a maximum of 1.4V. The supply of current and voltage is self-regulating within these limits so that no deposits of sulphide from the solution being treated occurs.

9 Claims, 6 Drawing Sheets

METHOD FOR RECOVERING SILVER FROM A PHOTOGRAPHIC FIXING SOLUTION

FIELD OF THE INVENTION

This invention relates to a method of recovering silver from a photographic fixing solution in which the solution is subjected to electrolysis between an anodic electrode and a cathodic electrode in order to deposit silver from the solution on to the cathodic electrode.

BACKGROUND OF THE INVENTION

For both economic and environmental purposes it is necessary to recover silver which goes into solution in a photographic fixing process. In economic terms it is desirable to recover the maximum amount of silver from the solution which is absorbed into the solution during the fixing of photographic films and plates. The silver thus obtained is able to be re-cycled and used further in photographic processes.

It is also necessary to ensure that any discharge from photographic processing equipment into the public utility sewage and river disposal areas are such that the effluent is substantially non-polluting and meets the standards set by the utility authorities. As far as silver is concerned, it is very necessary to ensure that the silver level is kept to an absolute minimum since the presence of silver in solution can have a poisonous effect on both plant and animal life.

There are basically two known methods of recovering silver from photographic fixing solutions. The first of these is a metal-exchange system of the type such as is marketed by the Applicants, which is usually placed between the overflow from a photographic processor and a drain. One typical example of such a metal-exchange unit is disclosed in U.S. Pat. No. 3,705,716, where steel wool is used as an anode and the iron ions pass out of the steel wool into solution to replace the silver ions which are plated onto a cathode. It is necessary in this system for the electrolyte to be monitored to ensure that the silver content does not rise above a predetermined low level which would seriously affect the standard of effluent discharged into the drain. When a rise in level of silver in the effluent is detected, the process has to be stopped and the unit is disconnected and sent off for refining.

The second method which can be used is that of an electrolytic silver recovery method where no metal exchange takes place, but silver from the solution is plated onto a cathodic electrode. It is very necessary to be able to control the electrolytic method to ensure that no action takes place which causes sulphiding. Sulphiding is where a sulphide of silver is caused to deposit from the electrolyte which would destroy the fixer solution itself and reduce the quality of the plated silver.

It has been recognised previously that extremely accurate control of the electrolysis conditions are necessary if sulphiding is to be avoided. For example, suggestions have been made in U.S. Pat. No. 4,263,108 to take samples of the cell condition periodically when the cell is in a zero current state and to apply a reference voltage and to monitor this voltage so that sulphiding is minimised. This requires an interruption in the plating process periodically.

A further silver recovery process using anodic and cathodic tanks separated by a diaphragm is known from U.S. Pat. No. 4,111,766. In this patent used solution from an overflow tank is fed to the anodic and cathodic tanks and subjected, on a batch basis, to electrolytic treatment.

An alternative suggestion has been made in U.S. Pat. No. 4,377,456 to provide a control electrode of pure carbon which provides a constant reference voltage.

It has been proposed that the electrolysis takes place in the main processing tank and that removable rotating cathodes are used. The purpose of the rotating cathode is to ensure that fresh fixing solution is properly circulated to the cathodic electrodes and that there are no areas of low concentration of silver or high concentration of sulphide created in the solution and that the whole solution is subject to treatment.

If the whole of the solution is being treated in the main fixing tank the electrodes, be they rotating or fixed, have periodically to be removed from the tank and sent away to a processing unit for recovery of the silver from them. It is better if any handling of fixer-coated electrodes is avoided.

Furthermore, it is necessary to check the concentration of the silver in the solution in the main fixing tank periodically which can mean either interrupting the process to take measurements or to operate a logging system to ensure that the number of films or area of film material treated does not become too high for the fixing solution to work effectively.

SUMMARY OF THE INVENTION

It is therefore an object of the present invention to provide a method of recovering silver from a photographic fixing solution by an electrolytic process in which there is no need for contact to be made with the electrodes or the chemicals in the area where photographic processing is taking place and that no complicated control or monitoring methods of the concentration of the solution are necessary.

According to a first aspect of the present invention, there is provided a method of recovering silver from a photographic fixing solution circulating in apparatus, in which apparatus the solution is subjected to electrolysis between a pair of anodic electrodes of the apparatus situated on either side of a cathodic electrode and separated therefrom by a substantially tubular insulating means, in order to deposit silver from the solution onto the cathodic electrode, the solution passing the electrodes from inlet means to outlet means of the apparatus in a circulatory manner so as constantly to present fresh solution to the electrolytic effect of the electrodes, and in which a current is supplied continuously to the electrodes at a voltage not exceeding 1.4 volts and at a level such that the current density at the cathodic electrode does not exceed 100 amps/$m^2$.

The voltage is preferably limited to a maximum of 1.4 volts and the current density is selectively adjusted to between 40 amps/$m^2$ and 100 amps/$m^2$.

The method employs stationary electrodes and these electrodes are preferably of a carbon or carbon-based material. The cathodic electrode is preferably given a precoating of silver prior to the operation of the recovery process. This precoating may be effected by using silver in the fixing solution.

The method may conveniently be effected in a separate unit from a main unit employed for a general photographic fixing operation and the method may then include circulating continuously the fixing solution from the main unit through the separate unit and back to the main unit. A recirculation pump may be used since it provides the agitation for fast processing.

Apparatus for use with the method may include in a separate unit a pair of electrodes separated from each other by a dielectric material and having means for receiving and circulating the fixing solution between the two electrodes.

In a preferred form of the separate unit it is provided with means for connecting the units together to secure a through flow of solution between the units. Such means may be self-sealing quick release means.

Preferably, the separate unit comprises two anodic electrodes with a cathodic electrode spaced and electrically insulated therefrom and positioned between the two anodic electrodes. Examples of operation of the method of the invention will now be described with reference to the accompanying drawings.

DETAILED DESCRIPTION OF THE INVENTION

Figure 1:
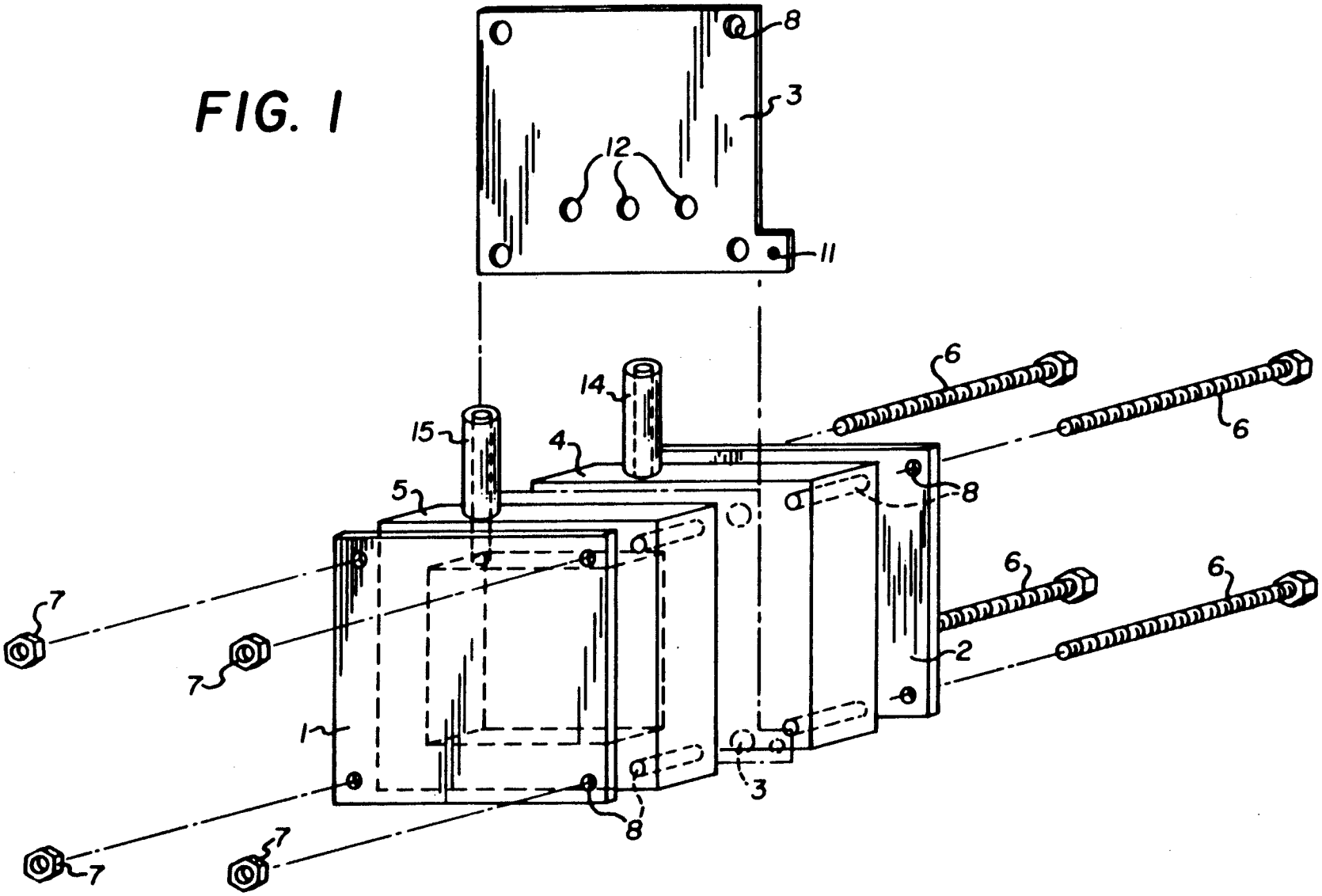
FIG. 1 shows an exploded view of the unit for carrying out the method of the invention and FIG. 2 shows a circuit diagram for controlling the operation of the unit of FIG. 1.

Referring first to FIG. 1, this shows the unit to be used with the method of the invention. It comprises a pair of anodes (1,2) which are separated from a cathode (3) by two identical PVC spacers (4,5). The anodes (1,2) and the cathode (3) can be of stainless steel, carbon or a carbon-based material. The PVC spacers are milled from thick PVC sheet and the whole cell is able to be connected by bolts and nuts (6,7) which pass through apertures such as 8, to hold the whole cell together in a watertight assembly.

The spacers (4,5) have tubular external connectors (14,15) which connect with the central area of the spacers through a bore in the wall of the spacers. The connectors (14,15) can be connected to fluid outlet connectors (not shown) on a main unit containing the body of the fixing solution and, preferably, the connections to a main processing unit are made by self-sealing hose connectors, for example such as those sold under the trade name of "Hozelok".

As can be seen from FIG. 1, the cathode (3) which is diagramatically shown outside the cell is provided with a terminal (11) to which an electrical connection can be made and has holes such as (12) through it to allow fixing solution to pass from one spacer to the other, for circulation purposes.

Figure 2:
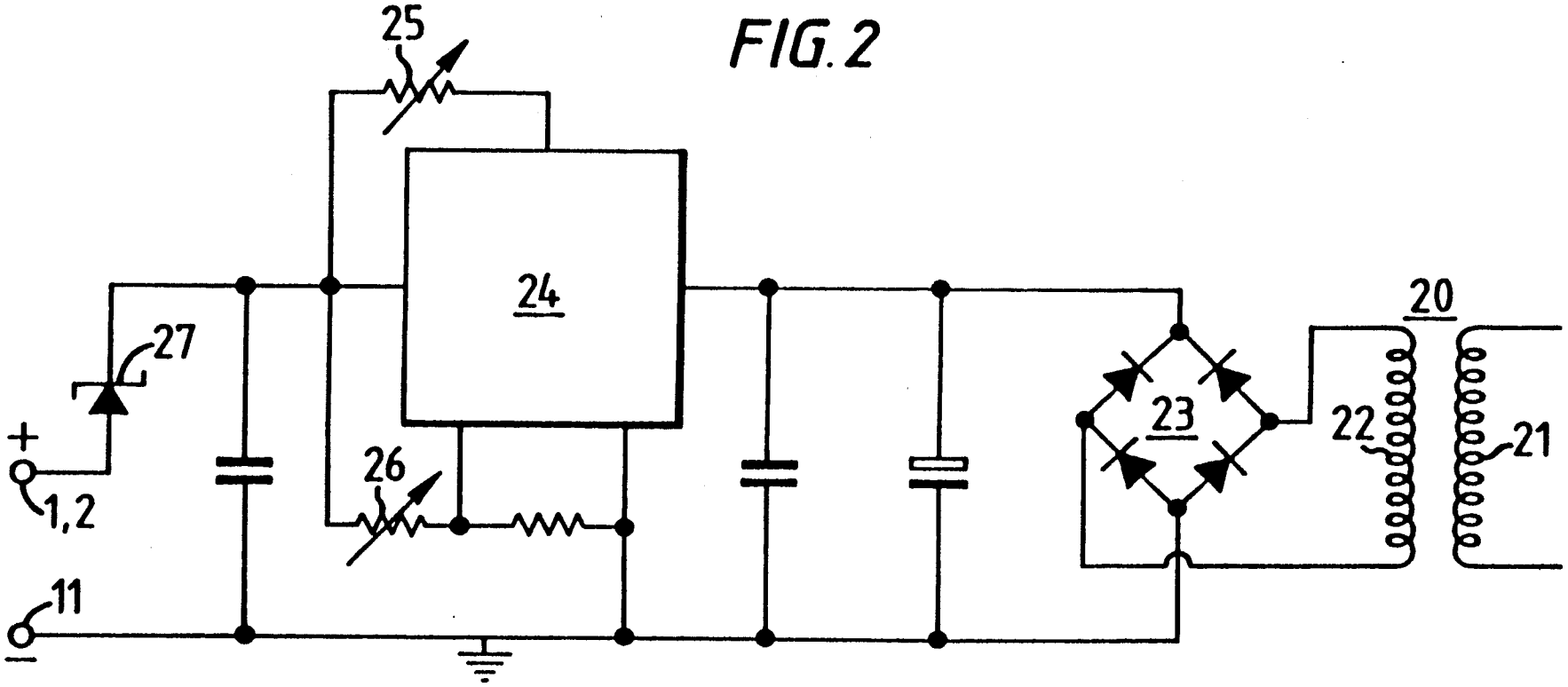

Referring now to FIG. 2, this shows a circuit diagram for supplying power to the unit of FIG. 1.

In FIG. 2, power for a main supply is fed to the primary winding (21) of a transformer (20) at 240 volts and step down in the secondary winding (22) to 9 volts. This AC voltage is rectified in a bridge rectifying circuit (23). one side of the rectifying circuit (23) is connected to earth and also to the terminal (11) of the cathodic electrode (3) of FIG. 1. The positive side of the rectifier (23) is connected to a microchip circuit (24) which, in this example, is an adjustable current and voltage regulator. The particular one used in this example is that sold under the reference L200 by Radio Spares Ltd.

The output of the regulator (24) is able to be adjusted by the variable resistors (25,26) to adjust the voltage and current output. This output is fed via zener diode (27) to the anodic electrodes (1,2) of the cell of FIG. 1. Suitable smoothing capacitors are also included in the circuit as shown.

In use the tubes (14,15) were connected up to the main unit and fixing solution was passed through them and, hence, through the cell. A small pump (not shown) was used to circulate the liquid between the two units at a rate in excess of 1 liter/minute to prevent a build up of concentration gradients in the solution. Initially, the cathodic electrode (3) was plated with a small amount of silver by separately connecting the unit to a pump to circulate a liter of fixer containing 10 g/l of silver and applying a potential to the unit to give a density of $5A/M^2$ for five hours. The fixer here, which was first artificially seasoned, gave an initial plating to the cathode and the unit was basically then primed for connection to the main solution tank. This tank was part of a minilab film processor which was designed to process up to 25 films per hour.

The main tank was filled with standard C-41-B chemicals and replenishment took place as described in the appropriate literature with the exception of the fixing solution. The fixing solution was not replenished except for the addition of undiluted C-41-B fixative solution at the beginning of each day's processing so that the thiosulphate ion concentration was brought to the correct level. When the film processor was operating the power supply was connected via the circuit of FIG. 2 to the unit of FIG. 1. The fixing solution continuously circulated through the unit of FIG. 1 and the voltage and current supply were controlled so that a current density above $40amps/M^2$ and below $100\ amps/M^2$, in this case, of the order of $50A/m^2$ was applied to the cathodic electrode at a voltage not exceeding 1.4 volts. This current density level was found to be sufficient to cope with the load of film being processed. The power supply to the recovery cell was continuous whenever the processor was operating.

It was found that with the processor running for about 10 hours per day with an average of 70 m of VR100 Gold film, exposed to a standard extent, being processed a final silver concentration in the fixer was 0.95 g/l, after a total of 697 m of film had been processed. At no time did the silver concentration exceed 3 g/l in the fixer tank and the fixer remained clear and free from precipitates of sulphides at all time.

When the unit was disconnected and the cathodic electrode examined it was found that the silver had plated evenly on both sides and consisted of white compact dendritic silver over a single flake. This silver was easily removed from the electrode by flexing the electrode and the total amount of silver was of the order of 125 g. This compared with an expected recovery of 155 g. However, since a second fixer tank was being used and it was found that the solution in this tank had a silver content of the order of 3.7 g/l silver for a volume of 6.51, it was calculated that this accounted for the remaining 30 g of silver. A separate unit could also have been applied to the second fixer tank to recover, or substantially recover, all of this 30 g.

The current flowing through the recovery unit is adjusted to give the best plated silver dependent on the agitation or circulation rate. The maximum voltage is dependent on the constituents of the fixer and is adjusted to avoid sulphide depositions. In order experimentally to determine more precisely the actual current and voltage levels and their limits, the following two examples were examined:

EXAMPLE 1

500 mls of fixer that had been artificially seasoned by adding silver chloride to give a final concentration of 19 g/l were put in a 600 ml stainless steel beaker. Into this was placed a 3cm magnetic stirring bar and the whole placed on a magnetic stirrer. A silver plated copper plate masked out with a rubber paint to give an electrode area of 50 $CM^2$ was lowered into the beaker. This electrode was connected to the negative termal (11) of a power supply whose circuit was similar to that shown in FIG. 2. The positive terminal was connected to the outside of the stainless steel beaker (which acts as the anodic electrode for the system).

Figure 3:
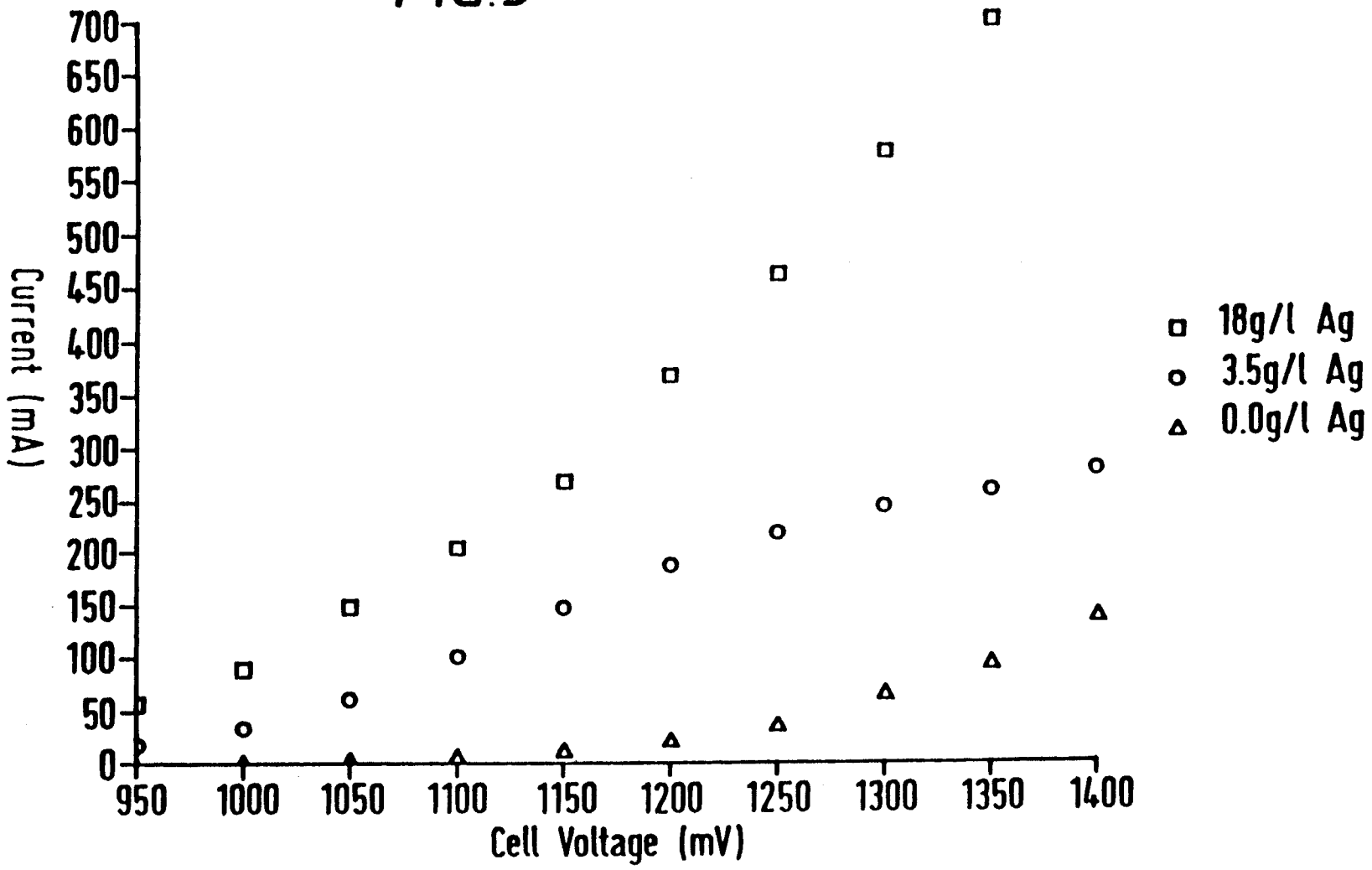
FIGS. 3, 4, 5 and 6 show graphically representations of current and voltage and efficiency curves.
Figure 4:
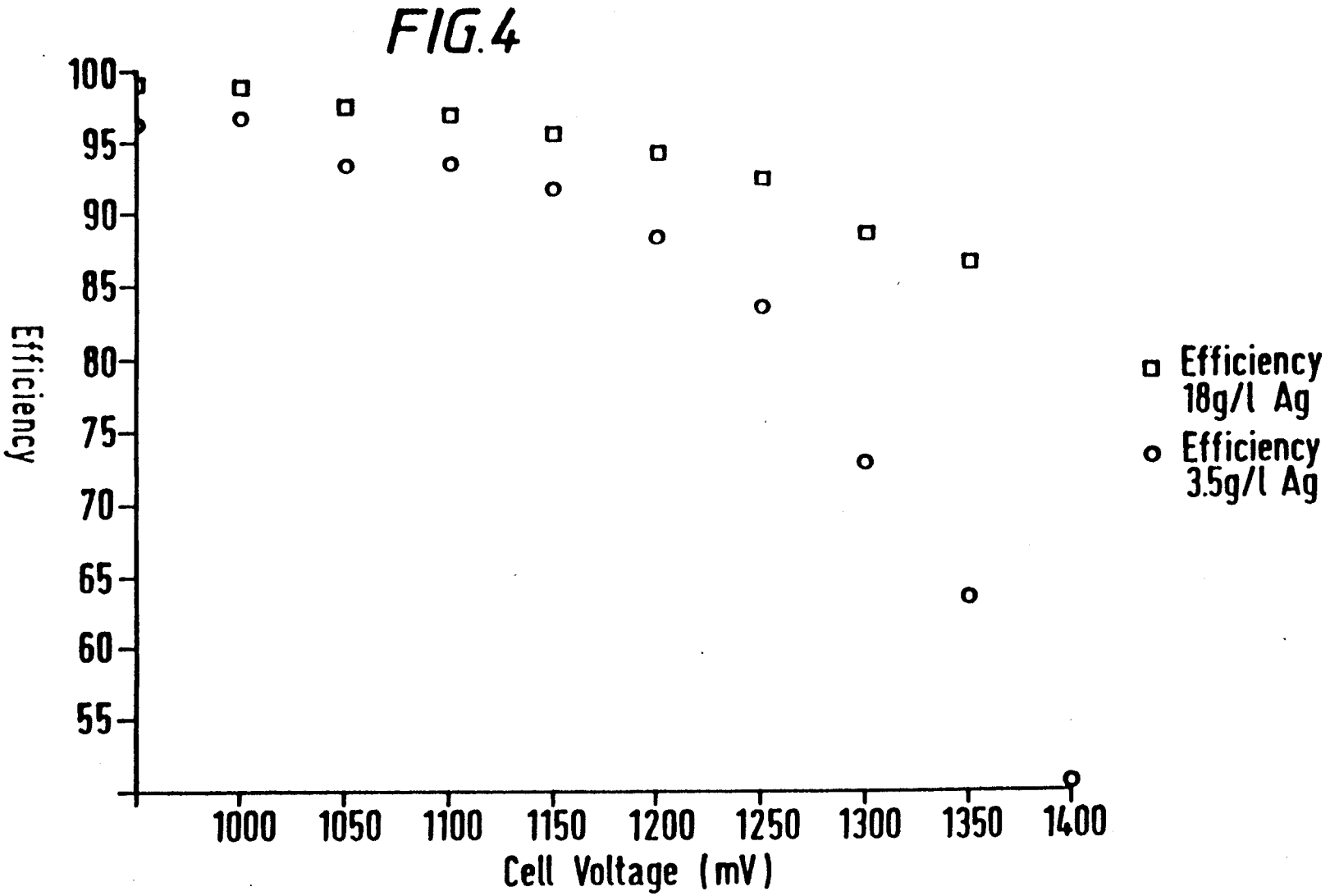

The magnetic stirrer was started at 500 r.p.m. giving good agitation. Electrolysis was begun by turning on the current at a voltage below 1.4 volts and limiting the cathode current density to 100 $A/m^2$ (500 mA). Electrolysis was continued by increasing the voltage at this constant current until a voltage of 1.4 V was reached. At this point the electrolysis current was limited by this voltage being applied to the cell unit. Current versus voltage curves for the cell's operation were determined at different levels of silver concentration in the fixer. These are shown in FIG. 3. Efficiency of the recovery of silver was also determined and is shown in FIG. 4. As can be seen, at high concentrations of silver the system is limited by the current flowing i.e. the voltage is lower than 1.4 V for a current of 500 mA, but as the concentration of silver drops so voltage control takes over. The overall efficiency of the system to recover silver is silver concentration dependent and also voltage dependent.

The silver recovered was as shiny white continuous flakes.

Electrolysis was continued after there was less than 0.1 g/l of silver present and at a cell voltage of 1.4 V. No fixer sulphiding was noticed after running the cell in this condition for 300 hours continuously.

EXAMPLE 2

Figure 5:
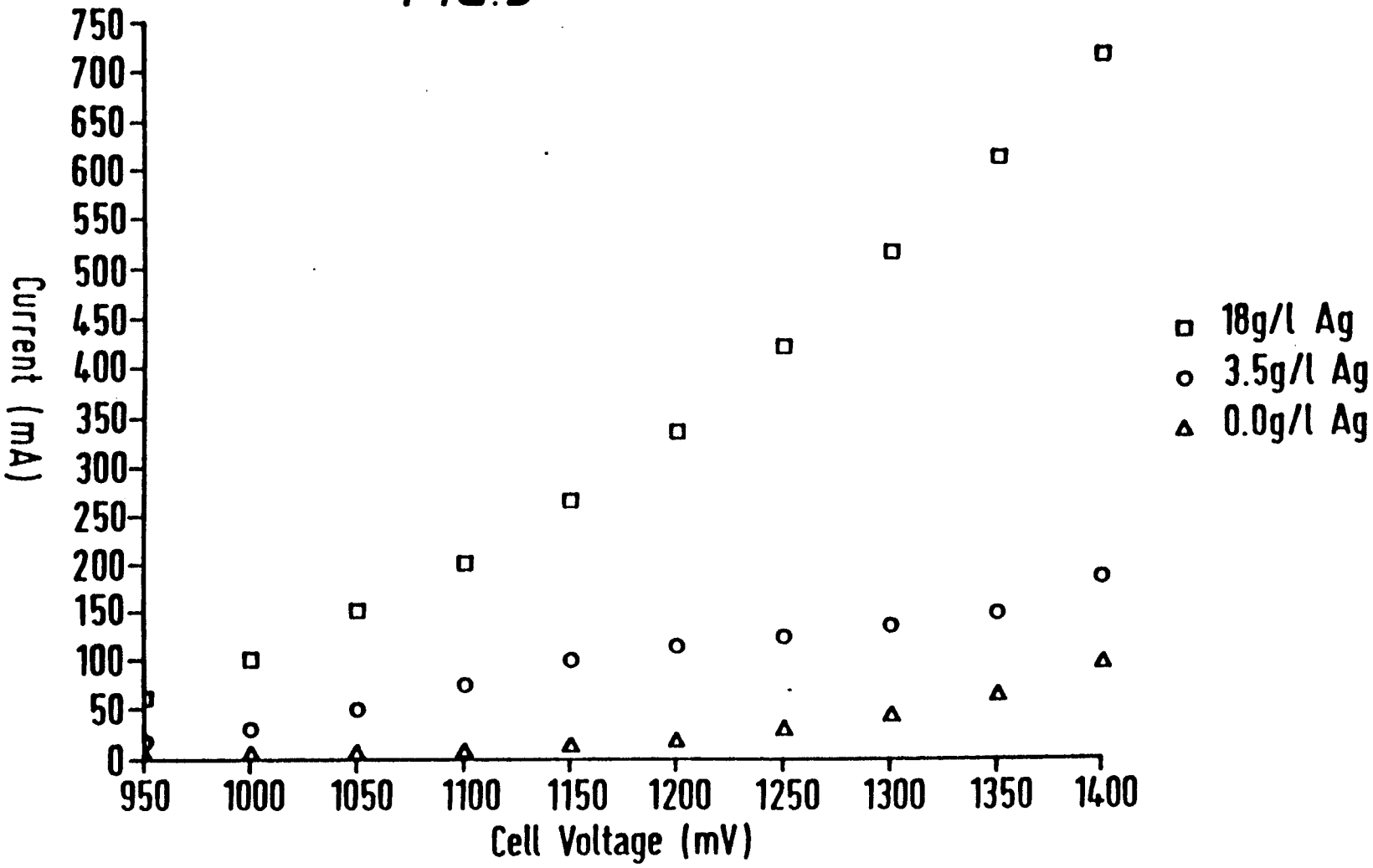
Figure 6:
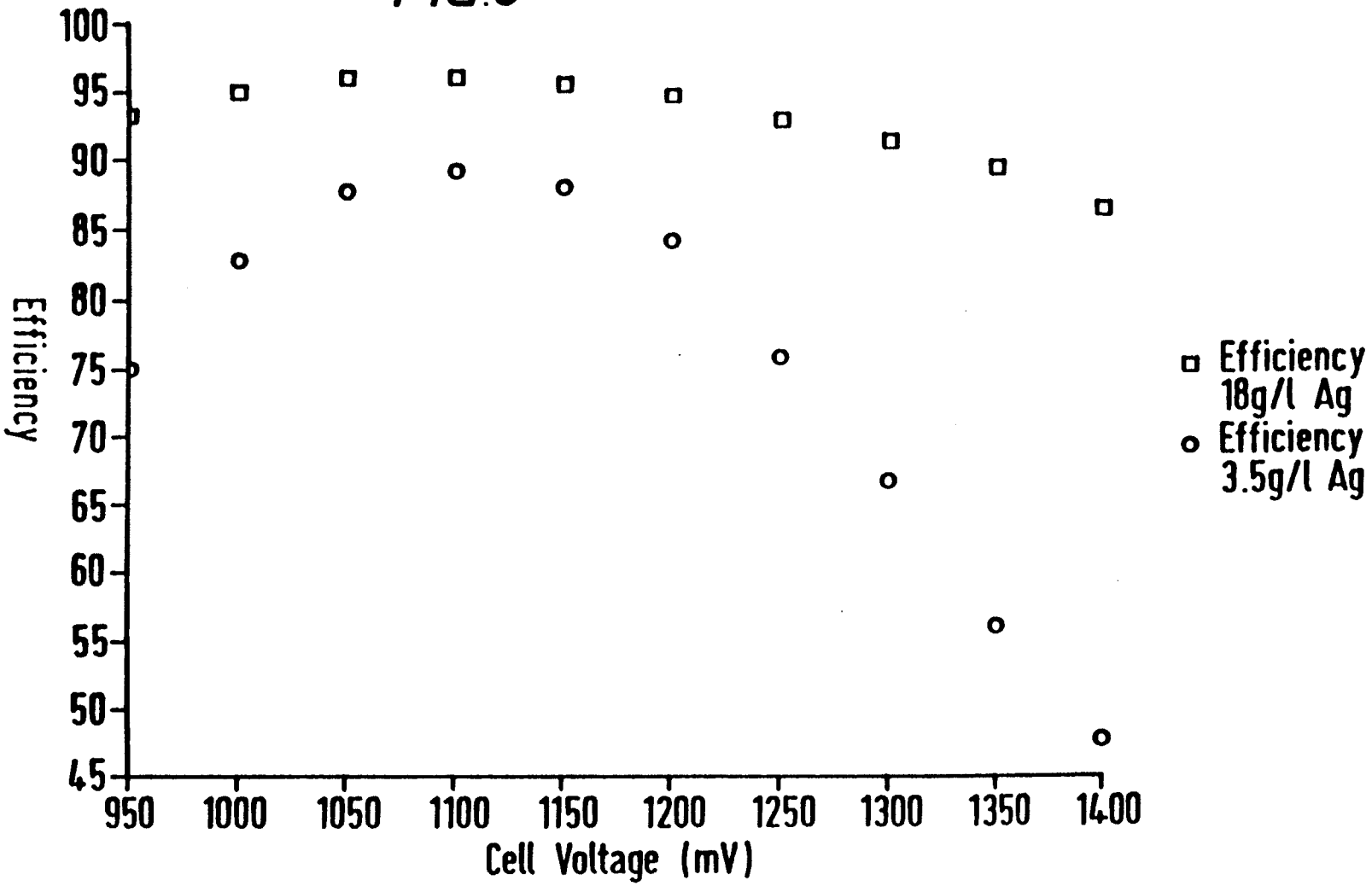

Example 1 was repeated with less agitation. The stirrer speed was set to 100r.p.m. The current versus voltage and the efficiency curves are shown in FIGS. 5 and 6 respectively. Similar results to example 1 were obtained except that the efficiency and current, at a given voltage, were less.

Again the silver plated out was as white shiny continuous flakes.

After the silver level had dropped below 0.1 g/l electrolysis was continued at 1.4 V. After 300 hours no sulphide was noticed.

It will thus be appreciated that since the unit is able easily to be connected and disconnected to the main unit, it is very easy to replace the unit when sufficient silver has been extracted from a photographic fixing solution and to take the unit away for recovering the silver from the electrode without there being any need at all for the solution or the unit components to be handled on site. While one unit is being salvaged for silver a replacement unit can be fully functioning with the minimum of disturbance to the overall processing operation. The state of the unit itself can be determined by monitoring the state of the power supply and no separate electrodes are necessary and it is also not necessary for the processing to be interrupted while an analysis of the solution takes place.

The great advantage to a user of the processing system is that the fixing solution is always kept low in silver and therefore only one fixing bath is required and it is not necessary to have any change of fixing solution from one bath to another.

Since the whole system is so efficient, there is very little risk of any significant silver being retained in the effluent from the process and therefore causing any detrimental environmental hazard as it enters into the normal drainage systems.

The quality of the silver salvaged is high and is capable of being recycled without further significant processing. Furthermore there is less need to replenish the system with fresh solution, to maintain active ingredient concentration.

I claim:

1. A method of recovering silver from a photographic fixing solution comprising:

circulating the solution through electrolytic apparatus having inlet means and outlet means and including a pair of anodic electrodes situated on either side of a cathodic electrode and separated therefrom by insulating means, the solution passing the electrodes from the inlet means to the outlet means in a circulatory manner so as constantly to present fresh solution to the electrolytic effect of the electrodes, applying a current and a voltage to the electrodes using a voltage regulator to optimize recovery of silver from the solution, and first automatically adjusting the voltage for a fixed current until the voltage reaches a value not exceeding 1.4 V and then fixing the voltage at this value and varying the current to maintain a current density at the cathodic electrode not exceeding 100 $Am^{-2}$.

2. A method according to claim 1, including limiting the current density to 100 $Am^{-2}$ until the voltage reaches 1.4 V using the voltage regulator.

3. A method according to claim 1, wherein the current density is between 40 $Am^{-2}$ and 100 $Am^{-2}$.

4. A method according to claim 1 including providing the cathodic electrode with a plurality of apertures through which the solution is passed.

5. A method according to claim 1, including the step of precoating the cathodic electrode with silver prior to connection to the photographic fixing solution.

6. A method according to claim 1, wherein at least one of the electrodes is of carbon or a carbon-based material.

7. A method according to claim 1, wherein the electrolytic apparatus is located in a separate unit from a main unit employed for a general photographic fixing operation, the inlet means and outlet means of the electrolytic apparatus being connected respectively to outlet means and inlet means of the main unit, and fixing solution is continuously circulated from the main unit through the separate unit and back to the main unit.

8. A method according to claim 7, wherein the respective outlet and inlet means are provided with quick release means for connecting the two units together.

9. A method according to claim 8, wherein the quick release means are self-sealing.

* * * * *